US008839765B2

(12) United States Patent
Guggenbichler

(10) Patent No.: US 8,839,765 B2
(45) Date of Patent: Sep. 23, 2014

(54) APPARATUS FOR INJECTING FUEL INTO THE COMBUSTION CHAMBER OF AN INTERNAL COMBUSTION ENGINE

(75) Inventor: Franz Guggenbichler, Kuchl (AT)

(73) Assignee: Robert Bosch GmbH, Stuttgart-Feuerbach (DE)

( * ) Notice: Subject to any disclaimer, the term of this patent is extended or adjusted under 35 U.S.C. 154(b) by 371 days.

(21) Appl. No.: 13/257,139

(22) PCT Filed: Mar. 16, 2010

(86) PCT No.: PCT/AT2010/000079

§ 371 (c)(1),
(2), (4) Date: Sep. 16, 2011

(87) PCT Pub. No.: WO2010/105282

PCT Pub. Date: Sep. 23, 2010

(65) Prior Publication Data

US 2012/0006301 A1 Jan. 12, 2012

(30) Foreign Application Priority Data

Mar. 17, 2009 (AT) ..... A 425/2009

(51) Int. Cl.
*F02M 51/00* (2006.01)
*F02M 47/02* (2006.01)
*F02M 63/00* (2006.01)

(52) U.S. Cl.
CPC ..... *F02M 47/027* (2013.01); *F02M 63/0015* (2013.01); *F02M 63/0019* (2013.01); *F02M 2200/8061* (2013.01); *F02M 2200/04* (2013.01); *F02M 2200/08* (2013.01); *F02M 2200/9069* (2013.01); *F02M 2200/8053* (2013.01)
USPC ..... 123/472

(58) Field of Classification Search
USPC ..... 123/445, 454, 463, 467–472; 239/585.1–585.3; 251/129.16
See application file for complete search history.

(56) References Cited

U.S. PATENT DOCUMENTS 4,197,996 A * 4/1980 Giardini ..... 239/87
5,238,224 A 8/1993 Horsting (Continued)

FOREIGN PATENT DOCUMENTS

DE 19829380 A1 1/2000
DE 102007055872 A1 9/2008

(Continued)

OTHER PUBLICATIONS

International Search Report issued in International Application PCT/AT2010/000079.

(Continued)

*Primary Examiner* — John Kwon
*Assistant Examiner* — Johnny H Hoang
(74) *Attorney, Agent, or Firm* — Fitch, Even, Tabin & Flannery LLP

(57) ABSTRACT

An apparatus for injecting fuel into the combustion chamber of an internal combustion engine includes an injection nozzle (5) having an axially displaceable nozzle needle (17) to which the pressure present in a control chamber (13) when filled with fuel, can be applied in the axial direction to control the opening and closing movements of the needle. The pressure in the control camber (13) is controlled via a solenoid valve (7) opening or closing at least one inlet or outlet duct for fuel. A magnetic coil (28) cooperates with an armature (27) and a valve-closing member is coupled to the armature (27) and that can be pressed against a valve seat (15). The armature (27) is disposed in an armature chamber (19) into which the inlet or outlet duct (14) opens. The magnetic coil (28) is covered by a metal protective plate (30) on the side of the armature chamber.

10 Claims, 4 Drawing Sheets

(56) References Cited

U.S. PATENT DOCUMENTS

| | | | | |
|---|---|---|---|---|
| 5,341,994 | A | 8/1994 | Wakeman | |
| 5,711,277 | A * | 1/1998 | Fuseya | 123/496 |
| 6,029,632 | A * | 2/2000 | Augustin | 123/506 |
| 6,065,451 | A * | 5/2000 | Lebrun | 123/454 |
| RE37,633 | E * | 4/2002 | Fuseya | 123/496 |
| 2002/0125347 | A1 * | 9/2002 | Munezane et al. | 239/596 |
| 2003/0042456 | A1 * | 3/2003 | Makino | 251/129.16 |
| 2004/0159716 | A1 * | 8/2004 | Azam et al. | 239/5 |
| 2006/0113503 | A1 | 6/2006 | Mennicken et al. | |
| 2006/0202145 | A1 * | 9/2006 | Ricco et al. | 251/129.16 |
| 2007/0040139 | A1 * | 2/2007 | Niwa et al. | 251/129.16 |
| 2009/0281707 | A1 * | 11/2009 | Katsura | 701/103 |
| 2009/0288638 | A1 * | 11/2009 | Dintino et al. | 123/447 |
| 2009/0326788 | A1 * | 12/2009 | Yuasa et al. | 701/104 |

FOREIGN PATENT DOCUMENTS

| | | | |
|---|---|---|---|
| EP | 1760308 | A2 | 3/2007 |
| EP | 1967726 | A2 | 9/2008 |
| EP | 1967726 | A3 | 5/2009 |
| WO | WO 98/04826 | A1 | 2/1998 |
| WO | WO 2004/055357 | A1 | 7/2004 |

OTHER PUBLICATIONS

International Preliminary Examination Report issued in International Application PCT/AT2010/000079.

* cited by examiner

APPARATUS FOR INJECTING FUEL INTO THE COMBUSTION CHAMBER OF AN INTERNAL COMBUSTION ENGINE

CROSS-REFERENCE TO RELATED APPLICATIONS

This is a U.S. National Phase of International Application PCT/AT2010/000079, filed Mar. 16, 2010, and claims the benefit of foreign priority from Austrian Patent Application A 425/2009, filed Mar. 17, 2009, the entire disclosures of which applications are hereby incorporated herein by reference.

FIELD OF THE INVENTION

The invention relates to an apparatus for injecting fuel into the combustion chamber of an internal combustion engine, including an injection nozzle having an axially displaceable nozzle needle to which the pressure present in a control chamber filled with fuel can be applied in the axial direction to control the opening and closing movements of said needle, wherein the pressure in the control chamber is controlled via a solenoid valve opening or closing at least one inlet or outlet duct for fuel and in which a coil having a winding support cooperates with an armature and a valve-closing member that can be pressed against a valve seat is coupled to the armature, said armature being disposed in an armature chamber into which the inlet or outlet duct opens.

BACKGROUND OF THE INVENTION

In servo-controlled injectors for internal combustion engines and, in particular, common-rail injection systems, injection control is performed by the aid of a solenoid valve. The solenoid valve controls the outflow of fuel from the control chamber of an injection nozzle. A servo-controlled injector according to the prior art is illustrated in FIG. 1.

FIG. 1 depicts the schematic structure of a modular common-rail injection system. Fuel is sucked from the fuel tank 1 by a prefeed pump 2 and, by a high-pressure pump 3, is brought to the required system pressure and fed to the injector 4. The injector 4 is comprised of an injection nozzle 5, a throttle plate 6, a solenoid valve 7, an injector body 8 equipped with a high-pressure accumulator (not illustrated), and a nozzle clamping nut 9 for holding the components together. In the idle position, the solenoid valve 7 is closed such that high-pressure fuel flows from a high-pressure bore 10 via a transverse groove 11 and an inflow throttle 12 into the control chamber 13 of the nozzle 5, yet while blocking the outflow from the control chamber 13 via the outflow throttle 14 on the valve seat 15 of the solenoid valve 7. The system pressure applied in the control chamber 13 along with the force of the nozzle spring 16 presses the nozzle needle 17 into the nozzle needle seat 18, thus closing the injection holes 24.

As the solenoid valve 7 is actuated by activating the electromagnet 25 and the solenoid valve member 27 is lifted from the solenoid valve seat 15 against the force of a solenoid valve spring 26, it clears the passage through the solenoid valve seat 15, and fuel is flowing from the control chamber 13 back into the fuel tank 1 through the outflow throttle 14, the armature chamber 19 of the solenoid valve, the outflow gap 20, the relief bore 21 and the low-pressure bore 22. Within the control chamber 13, an equilibrium pressure defined by the flow cross sections of the inflow throttle 12 and the outflow throttle 14 adjusts, which is so low that the system pressure applied in the nozzle chamber 23 is able to open the nozzle needle 17, which is guided within the nozzle body 29 in a longitudinally displaceable manner, thus clearing the injection holes 24 and effecting injection.

Due to the geometry of the solenoid valve 7, the magnetic coil 28 proper (which consists of a plastic winding support and the copper wire windings) is in direct contact with the fuel such that damage may be caused due to cavitation erosion at the occurrence of cavitation in the system and, in particular, in plastic components as are used for the winding support of the magnetic coil 28. Cavitation develops in the following manner:

When the valve seat 15 is open, the armature 27 directly abuts on the stroke stop of the magnet pot 25 such that only a very small residual air gap of 50-80 μm will remain between the armature 27 and the magnet pot 25. When the magnet is deactivated, the force of the valve spring 26 causes such a strong negative pressure in said residual air gap that the fuel present in the residual air gap will at least partially evaporate over a short time. After this, the pressure will again rise, thus causing the vapour bubbles to explode. If this happens on the surface of the winding support of the magnetic coil 28, cavitation erosion will occur there, which with long running times may reach as far as to the copper windings of the magnetic coil 28 and finally destroy the same, thus causing a failure of the solenoid valve 7.

The present invention now aims to avoid such damage due to cavitation erosion.

SUMMARY OF THE INVENTION

To solve this object, the injection apparatus of the initially defined kind is essentially further developed such that the magnetic coil is covered by a metal protective plate on the side of the armature chamber. The surface of the magnetic coil facing the armature chamber, i.e. the side of the magnetic coil exposed to cavitation, is thus effectively protected against damage by the arrangement according to the invention, of a metal protective plate. By said measure of arranging a metal protective plate, which is extremely simple to structurally realize, it has become feasible to effectively prevent cavitation erosion on the (plastic) winding support without having to carry out structural changes or adaptations or material changes on the winding support. In doing so, the winding support itself and, in particular, the copper windings of the coil of the solenoid valve are to be protected.

DETAILED DESCRIPTION OF

An apparatus for injecting fuel into the combustion chamber of an internal combustion engine includes a control chamber and an injection nozzle having an axially displaceable nozzle needle. Pressure is present in a control chamber, such as when it is filled with fuel. The pressure can be controlled so as to displace the needle in the axial direction so as to control the opening and closing movements of the needle to thereby control the opening and closing of a port of the injection nozzle. The pressure in the control chamber is controlled via a solenoid valve that can open or close at least one inlet or outlet duct for fuel. A magnetic coil cooperates with an armature and a valve-closing member that can be pressed against a valve seat. The armature is disposed in an armature chamber into which the inlet or outlet duct opens. The magnetic coil is covered by a metal protective plate (30) on the side of the armature chamber.

In order that the provision of the metal protective plate involves as low an increase in the weight of the injector as possible, it is preferably provided that the protective plate is designed to be annular and is arranged in the annular cavity of the magnet pot receiving the coil, or in a manner covering said cavity.

The fixation of the protective plate can be effected in the most diverse ways. According to a preferred further development, the protective plate is, for instance, pressed into the magnet pot. This offers the advantage of simple mounting at a simultaneously high retention force.

It may alternatively be provided that the protective plate is welded with the magnet pot.

According to a further preferred configuration, it is provided that the annular protective plate is held in the cavity of the magnet pot by the aid of tongues overlapping the protective plate, said tongues being preferably formed of the material of the magnet pot, preferably by pressing on a caulking tool including projecting teeth.

The arrangement of a metal protective plate according to the invention naturally bears the risk of the mode of functioning of the electromagnet being affected. Interference with the magnetic field lines may, in particular, occur. In order to prevent such negative influences, it is provided according to a preferred configuration that the protective plate is made of a metal that does not interfere with the magnetic field lines, preferably stainless steel.

Figure 1:
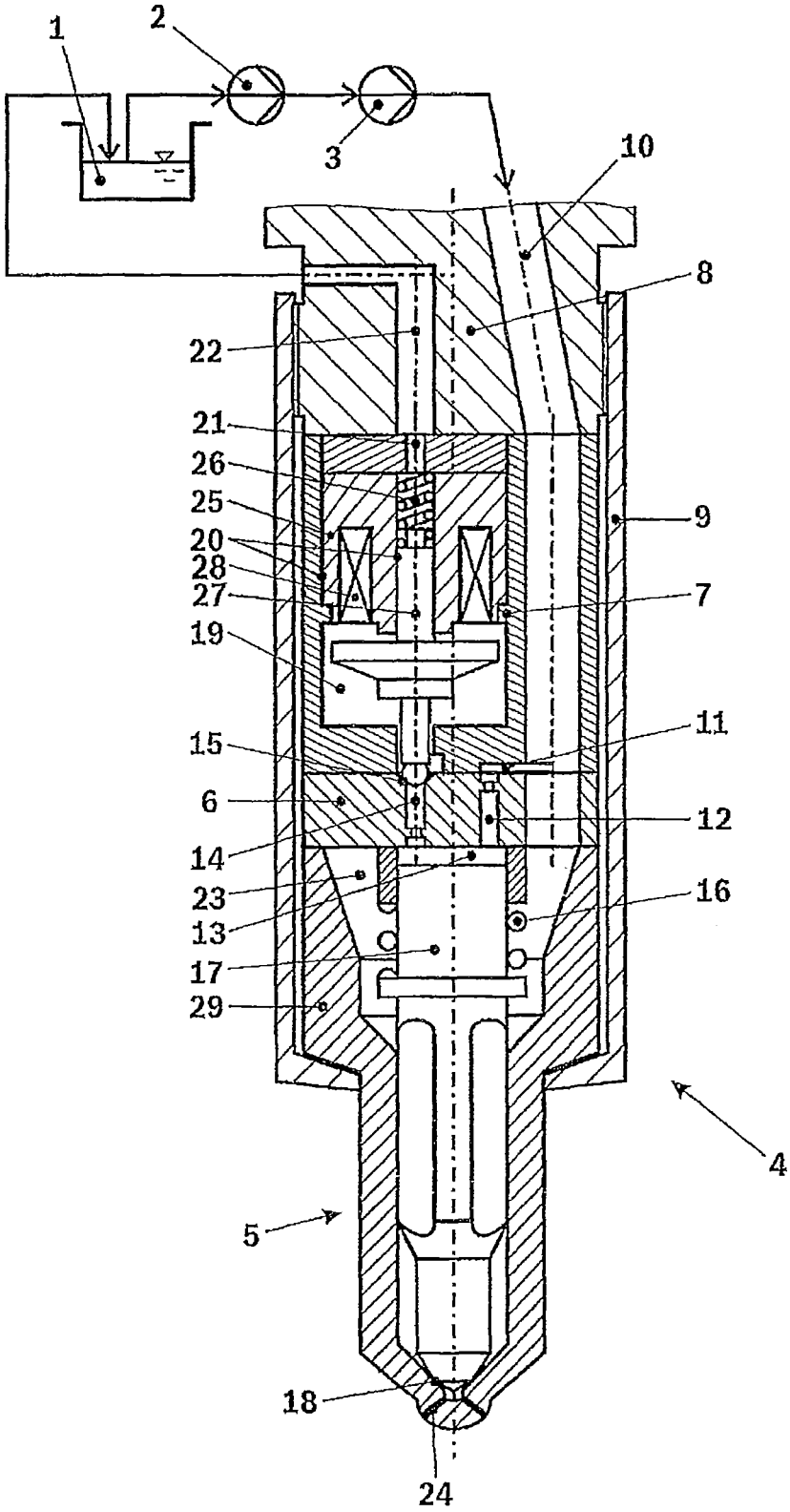
FIG. 1 depicts a schematic structure of a modular common-rail injection system.
Figure 2:
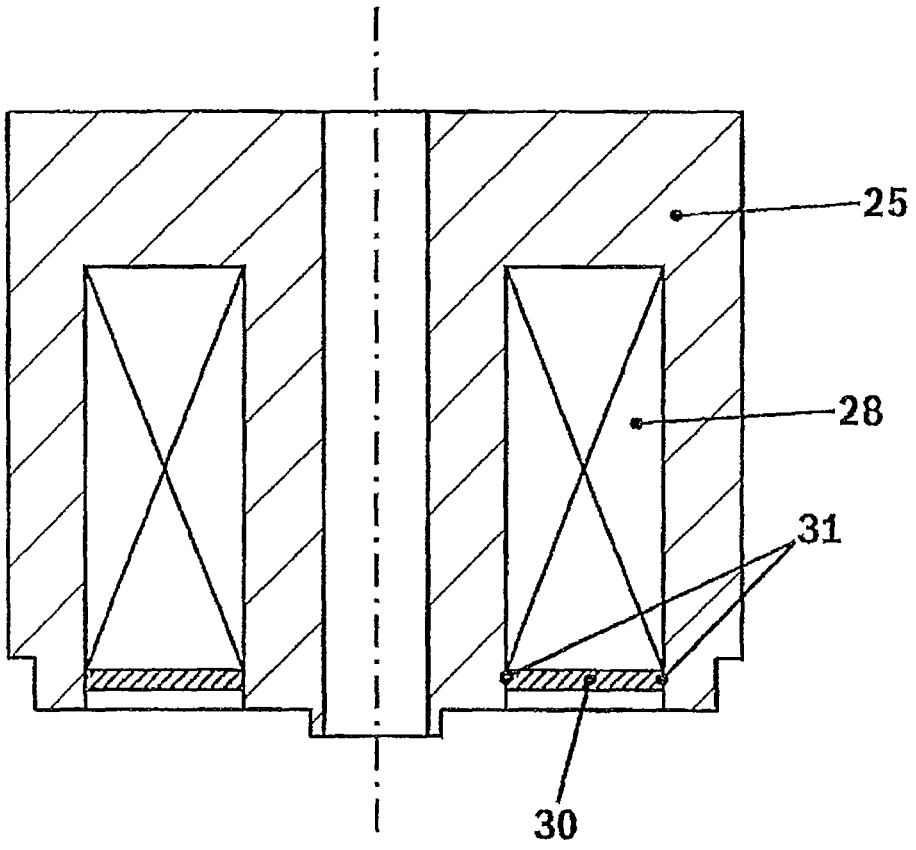
FIG. 2 is a detailed view of an injector of FIG. 1.
Figure 3:
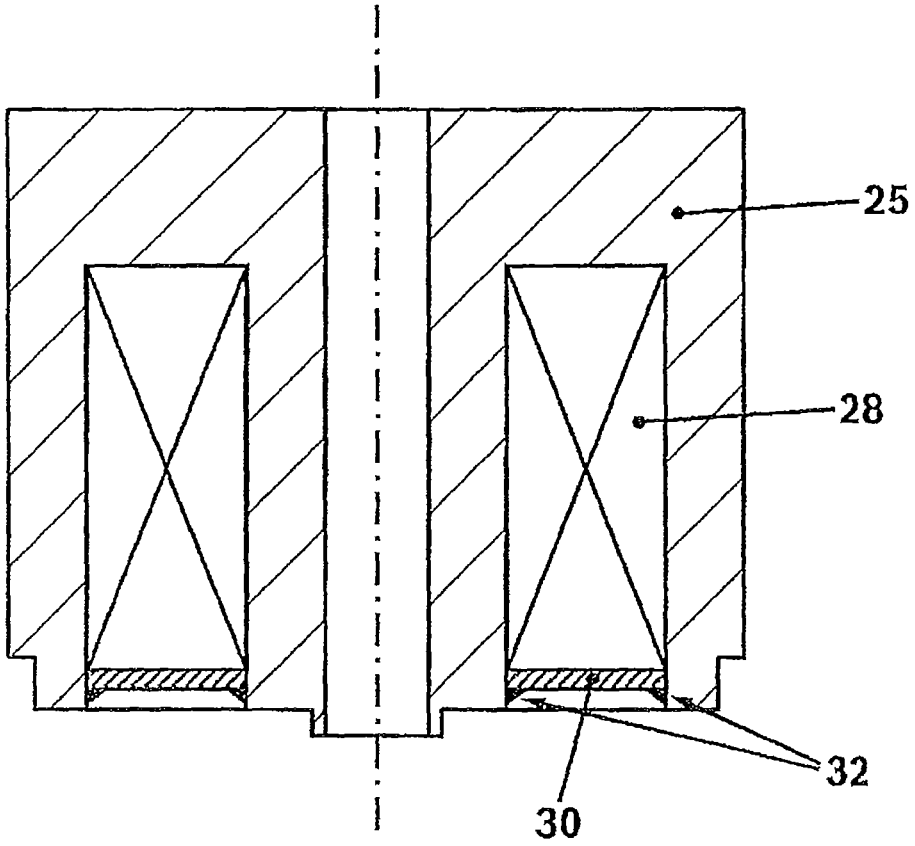
FIG. 3 depicts an alternative arrangement.

In the following, the invention will be explained in more detail by way of exemplary embodiments schematically illustrated in the drawing. Therein, FIG. 2 is a detailed view of an injector according to FIG. 1, which carries the protective plate according to the invention; FIG. 3 depicts an alternative configuration; and FIG. 4 illustrates a further alternative configuration.

FIG. 2 depicts a configuration of a magnet pot 25 according to the present invention. In front of the magnet coil 28 proper, a metal plate 30 is provided for its protection, which is pressed into the magnet pot 25 on its side edges 31. The metal plate 30 is preferably designed in such a manner as not to interfere with the build-up of the magnetic field lines in the magnet cycle, e.g. by using stainless steel.

FIG. 3 depicts an alternative configuration of the invention. The metal plate is shown as a metal disc 30 that is welded with the magnet pot 25 in points 32.

Figure 4:
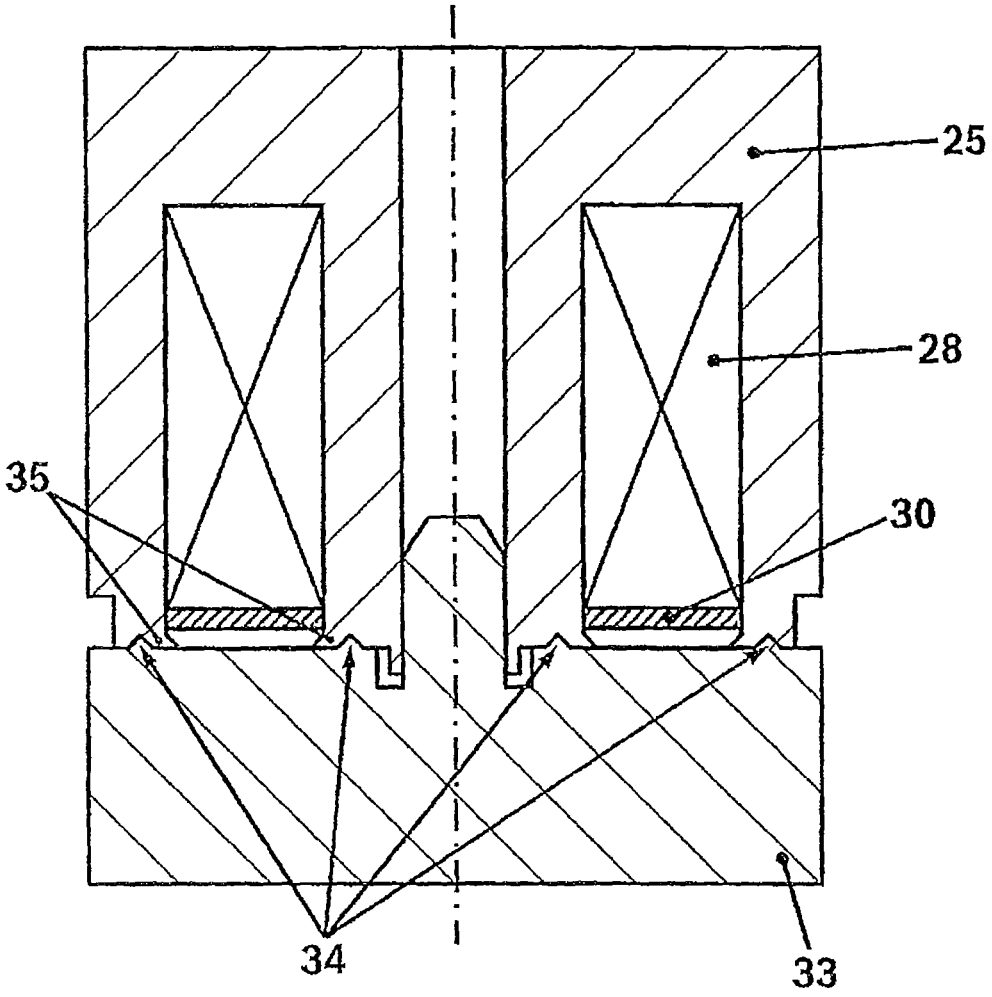
FIG. 4 depicts an alternative arrangement.

FIG. 4 illustrates another alternative configuration of the invention. The metal disc 30 is loosely inserted into the magnet pot 25 in front of the magnetic coil 28 in a first step. In a second step, it is caulked by the aid of a caulking tool 33 including teeth 34 projecting from the periphery several times, preferably six to eight times inside and outside the coil window. By pressing the caulking tool 33 on the magnet pot 25, the magnet pot is deformed in the region of the pole surface while forming tongues 35 that prevent the metal disc 30 from falling out, holding the same firm in its position.

The invention claimed is:

1. An apparatus for injecting fuel into the combustion chamber of an internal combustion engine comprising a control chamber, an armature chamber, an armature, a valve-closing and valve-opening member that is coupled to said armature, a valve seat, an injection nozzle having a port at one end and an axially displaceable nozzle needle so that said needle is displaceable in an axial direction in response to a pressure present in the control chamber, the axial direction being along a longitudinal axis of the injection nozzle, so as to control opening and closing of the port of the injection nozzle, a solenoid valve for opening or closing an inlet or outlet duct for fuel, a magnetic coil that cooperates with the armature and the valve-closing member so that the valve-closing member can be pressed against the valve seat, said armature being disposed in the armature chamber into which the inlet or outlet duct for fuel opens, said magnetic coil having an end that faces the armature chamber, and a metal protective plate (30) for preventing cavitation erosion of the magnetic coil, said metal plate being on a side of the armature chamber so as to cover the end of the magnetic coil that faces the armature chamber.

2. An apparatus according to claim 1, wherein the solenoid valve includes an annular cavity for receiving the magnetic coil, the magnetic coil is disposed in the cavity, and the protective plate (30) is annular and is arranged in the annular cavity of the solenoid valve so as to cover the end of the magnetic coil that faces the armature chamber.

3. An apparatus according to claim 1, wherein the apparatus further comprises a magnet pot (25), and the protective plate (30) is pressed into the magnet pot (25).

4. An apparatus according to claim 1, wherein the apparatus further comprises a magnet pot (25) and the protective plate (30) is welded with the magnet pot (25).

5. An apparatus according to claim 2, wherein the magnet pot (25) has a cavity and the annular protective plate (30) is held in the cavity of the magnet pot (25) by aid of tongues (35) overlapping the protective plate (30).

6. An apparatus according to claim 5, wherein said tongues (35) are formed of a material of the magnet pot (25).

7. An apparatus according to claim 1, wherein the protective plate (30) is made of a metal that does not interfere with the magnetic field lines.

8. An apparatus according to claim 1, wherein the solenoid valve (7) has an annular cavity for receiving the magnetic coil, the magnetic coil is disposed in the annular cavity and has an end facing the armature chamber, and the protective plate (30) is annular and is arranged to cover the cavity having the magnetic coil disposed therein.

9. An apparatus according to claim 6, wherein said tongues (35) are formed by pressing on a caulking tool having projection teeth (34).

10. An apparatus according to claim 7, wherein the metal comprises stainless steel.

* * * * *